US006906604B1

(12) United States Patent
Mader et al.

(10) Patent No.: US 6,906,604 B1
(45) Date of Patent: Jun. 14, 2005

(54) SECURITY RELAY

(75) Inventors: Leopold Mader, Moedling (AT); Rudolf Mikl, Arbesthal (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 09/807,689

(22) PCT Filed: Oct. 1, 1999

(86) PCT No.: PCT/EP99/07278

§ 371 (c)(1),
(2), (4) Date: May 19, 2003

(87) PCT Pub. No.: WO00/24019

PCT Pub. Date: Apr. 27, 2000

(30) Foreign Application Priority Data

Oct. 16, 1998 (DE) ..... 198 47 831

(51) Int. Cl.[7] ..... H01H 67/02
(52) U.S. Cl. ..... 335/129; 335/128
(58) Field of Search ..... 335/78–86, 128–131, 335/124

(56) References Cited

U.S. PATENT DOCUMENTS 5,160,910 A * 11/1992 Tsuji ..... 335/129
5,568,108 A 10/1996 Kirsch
5,831,502 A * 11/1998 Kirsch ..... 335/129
5,945,900 A * 8/1999 Shibata et al. ..... 335/128
6,034,582 A * 3/2000 Fausch ..... 335/78

FOREIGN PATENT DOCUMENTS

| | | | |
|---|---|---|---|
| DE | 969 149 | 5/1956 | |
| DE | 2517263 | 10/1976 | ..... H01H/50/64 |
| DE | 3437544 A1 | 4/1986 | ..... H01H/50/02 |
| DE | 19540739 A1 | 1/1997 | ..... H01H/50/64 |
| DE | 19600314 A1 | 7/1997 | ..... H01H/50/64 |
| FR | 2379904 | 5/1977 | ..... H01H/50/54 |
| FR | 2423855 | 4/1979 | ..... H01H/50/56 |
| GB | 618013 | 2/1949 | ..... H01H/50/64 |

* cited by examiner

*Primary Examiner*—Lincoln Donovan

(57) ABSTRACT

A relay having a base on which is arranged an electromagnetic system that actuates at least one pair of closing contact springs and at least one pair of opening contact springs where actuation is effected by a slide having actuation lugs located at different heights relative to the fixing of the active spring contacts for actuating the active opening spring contacts at a height different from that of the active closing spring contacts so that the characteristic curve of the magnetic system can be better adjusted to that of the spring contacts.

10 Claims, 6 Drawing Sheets

SECURITY RELAY

BACKGROUND OF THE INVENTION

The present application is related to PCT application EP 99/07278 filed on Oct. 1, 1999 and claims the priority data thereof.

1. Field of the Invention

The invention relates to a relay, having: a base which defines a base plane; a magnet system arranged on the base and having a coil, a core and an armature; at least one pair of closing spring contacts and at least one pair of opening spring contacts, each pair of spring contacts including an active and a passive spring contact, and each spring contact being secured in the base, standing perpendicular to the base plane, and bearing at its end remote from the base a contact portion; and an actuating slide which is movable parallel to the base plane and which acts on each movable spring contact, in each case in the vicinity of the contact portion.

2. Summary of the Prior Art

A relay of this type with forcibly guided contacts is known from DE 195 40 739 A1. There, the individual contact springs are arranged insulated from one another, with special structural measures also being taken to prevent short circuits in the event that contact portions become detached from the spring contacts. In this known relay, the active spring contacts, below the contact portions, are guided and actuated in laterally open slots in a slide. Laterally open actuating portions alter the stability of the slide, however, with the result that such slides already have a tendency to warp even during manufacture and do not retain optimum dimensional stability in operation either. A further problem with relay constructions of this kind consists in the fact that the force for opening the opening springs has to be overcome at the beginning of the movement of attraction of the armature, while the force for closing the closing contacts occurs towards the end of the armature movement of attraction. Since the force of an electromagnet system is small at the beginning of the armature movement of attraction, however, and only rises steeply towards the end of the movement of attraction, when the operational air gap is almost closed, application of the opening force is a problem which is typically solved by making the magnet system large in size, with this over-sizing not being necessary to close the closing contacts.

SUMMARY OF THE INVENTION

The object of the present invention is to construct a relay of the type mentioned at the outset such that the characteristic curve of the spring can be better adapted to that of the magnet system.

BRIEF DESCRIPTION OF THE DRAWINGS

According to the invention, this object is achieved in that the slide acts on the active opening spring contacts at a different spacing as regards the way it is secured in the base from that at which it acts on the active closing spring contacts.

The formation of a slide, according to the invention, having different points of action on the opening spring contacts and the closing spring contacts as regards the way they are clamped in the base is achieved in that the opening contacts are opened with as small a force as possible and as long a distance as possible, while the closing contacts are closed with a short lever arm over a short distance. In this way, the force to be applied to open the opening contacts is therefore adapted to the force of the magnet system, smaller at the beginning of the movement of attraction, while the great magnetic force at the end of the movement of attraction of the armature is sufficient to actuate the closing contacts over a short distance, that is to say with a small lever arm. The result is an adaptation of the characteristic curve of the spring to that of the magnet system which is more precise overall, so that the magnet system itself is relatively small in size.

In a preferred-embodiment of the relay according to the invention, it may furthermore be provided that all the active spring contacts are of the same construction, so that neither the active opening spring contacts nor the active closing spring contacts are pre-tensioned in the direction of the associated passive spring contacts. The opening spring contacts are then actuated by an armature spring, while the closing spring contacts are actuated by the magnet system.

Further advantageous embodiments are specified in the subclaims.

Figure 1:
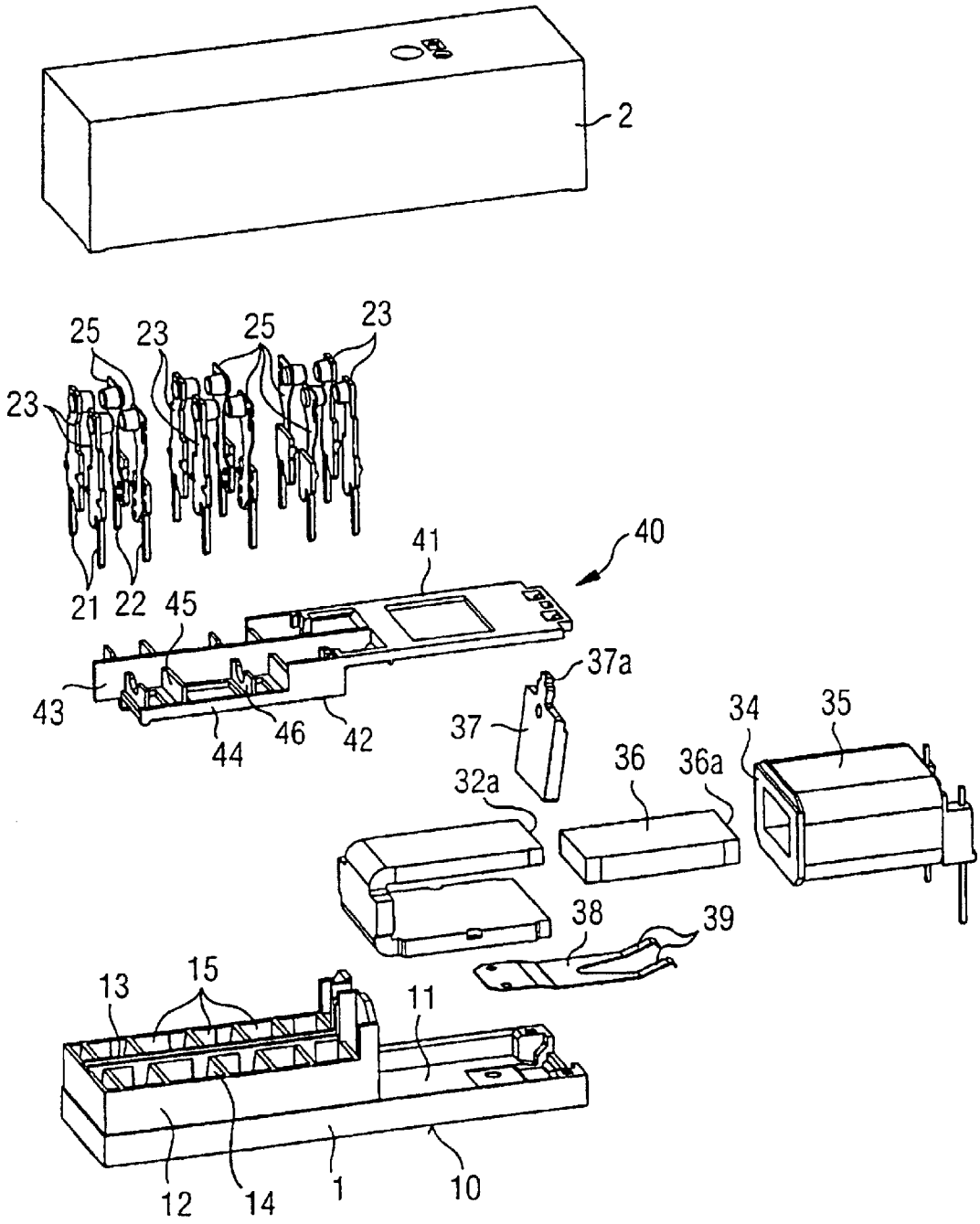
Figure 2:
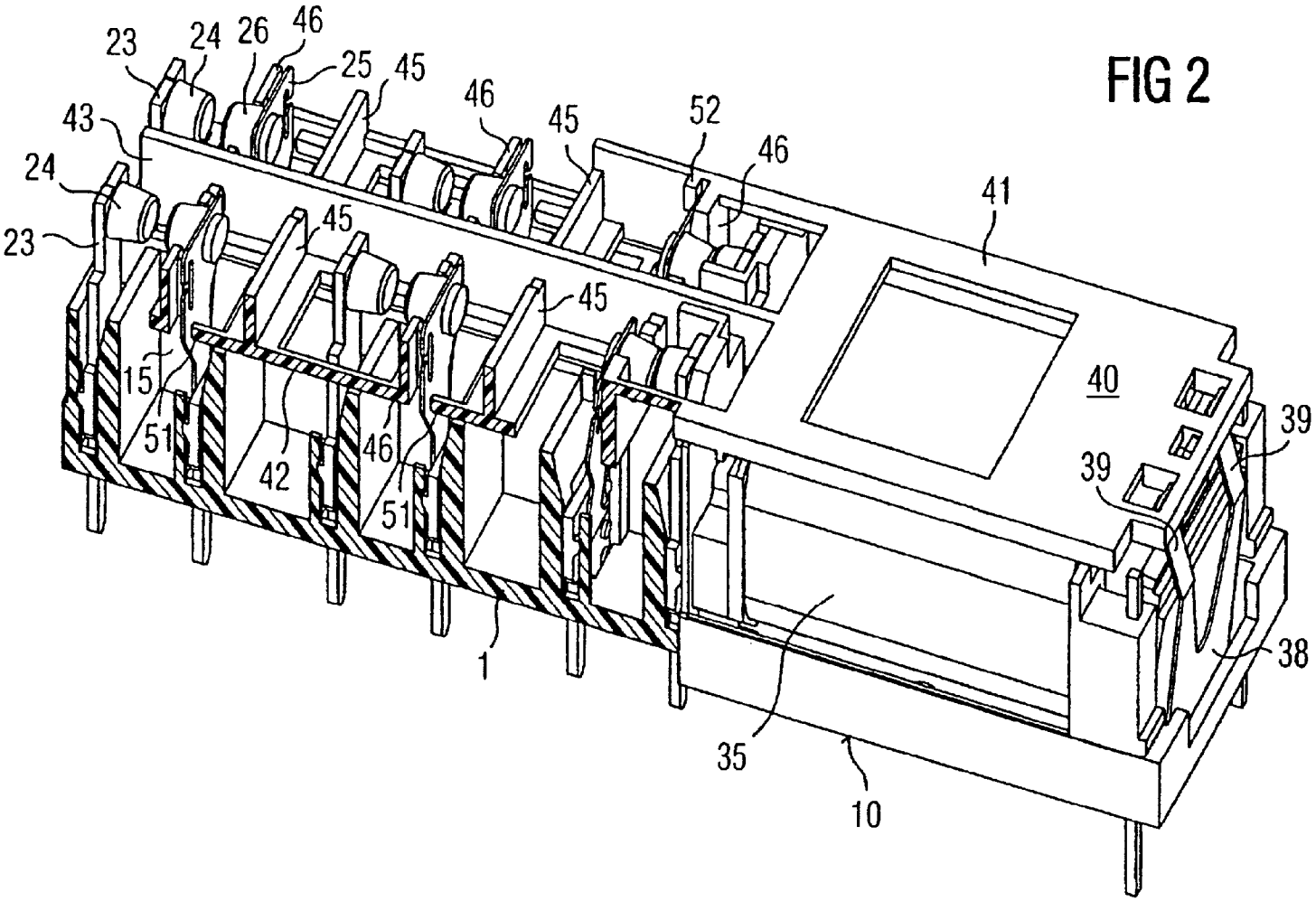
Figure 3:
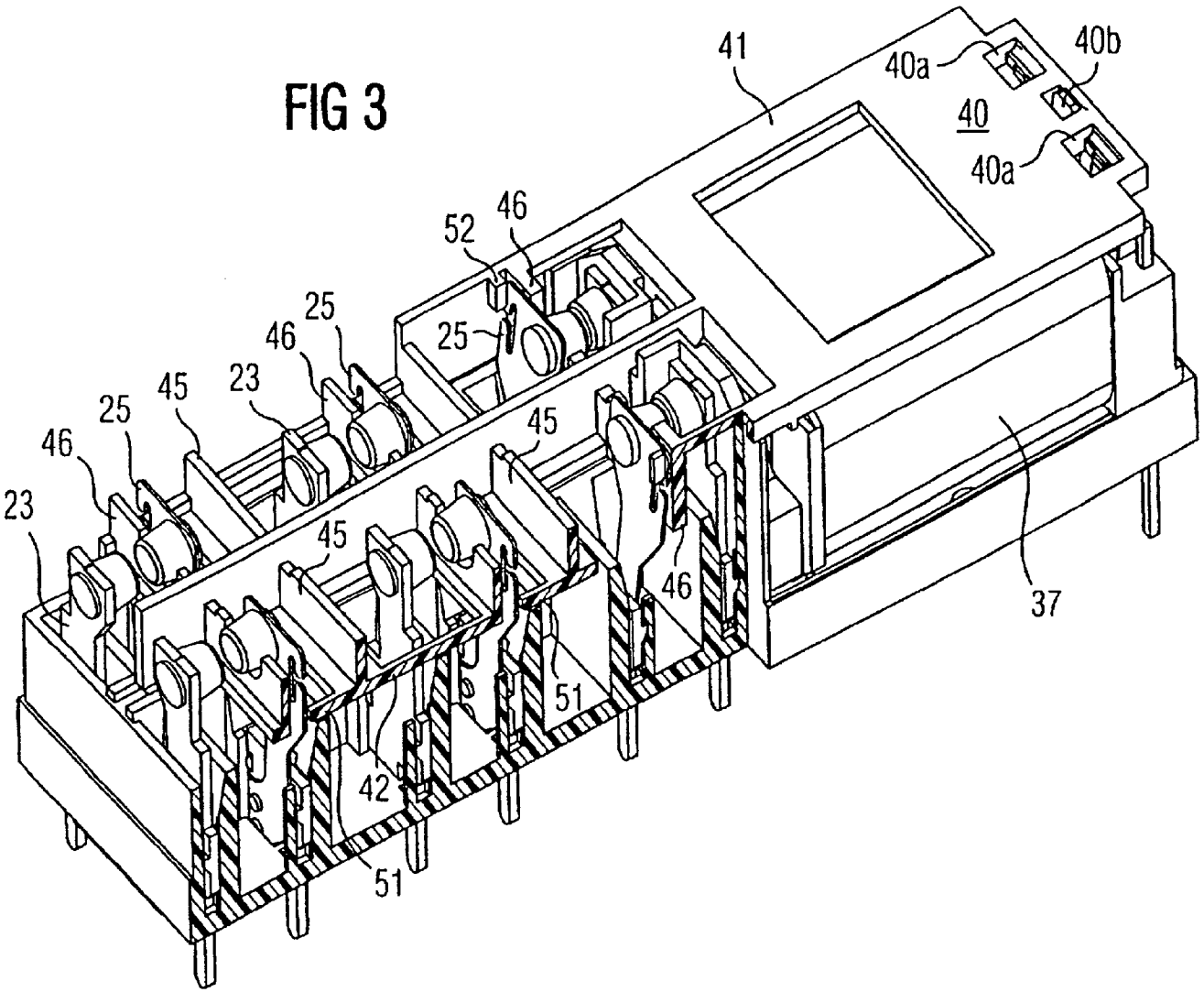
Figure 4:
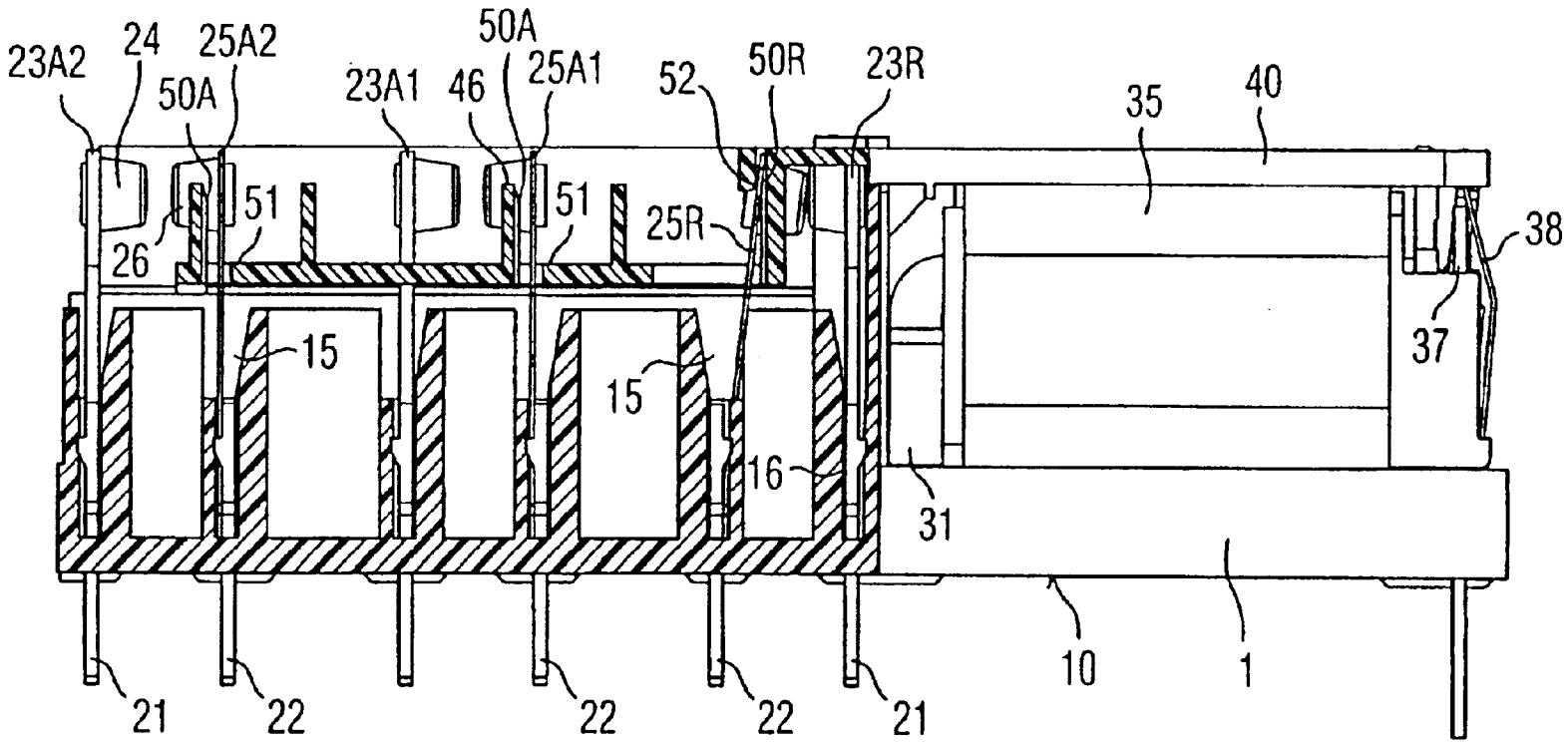
Figure 5:
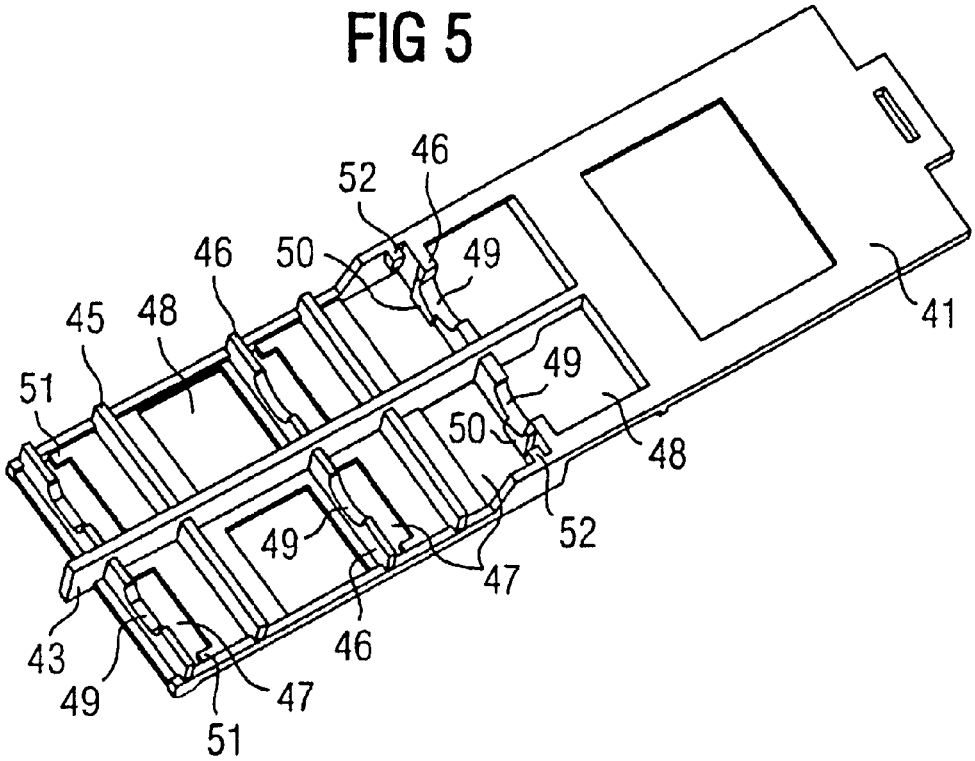
Figure 6:
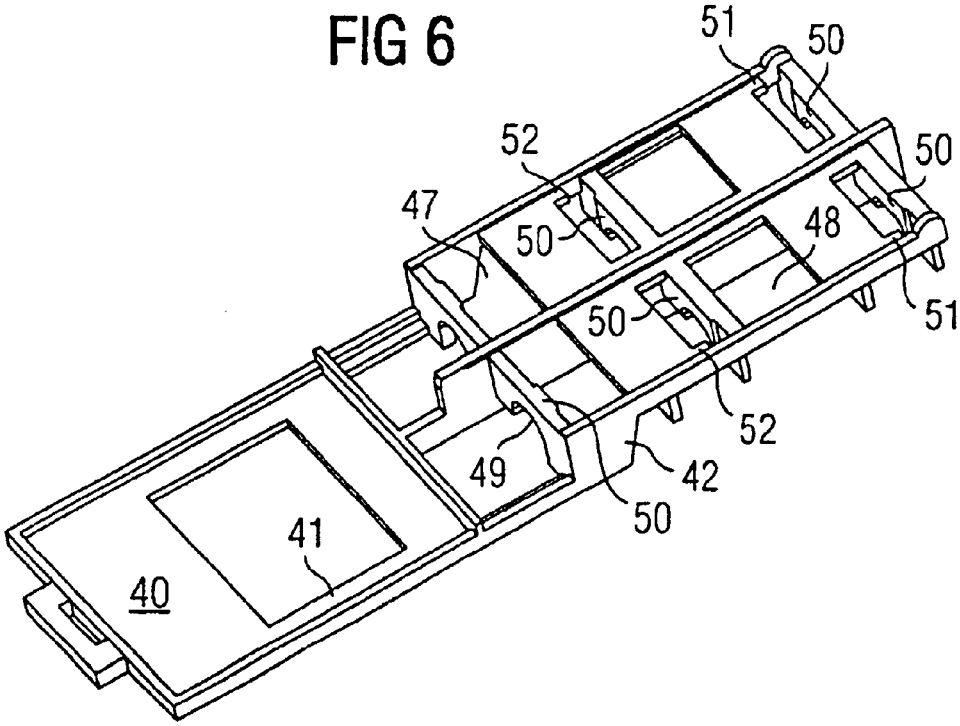
Figure 7:
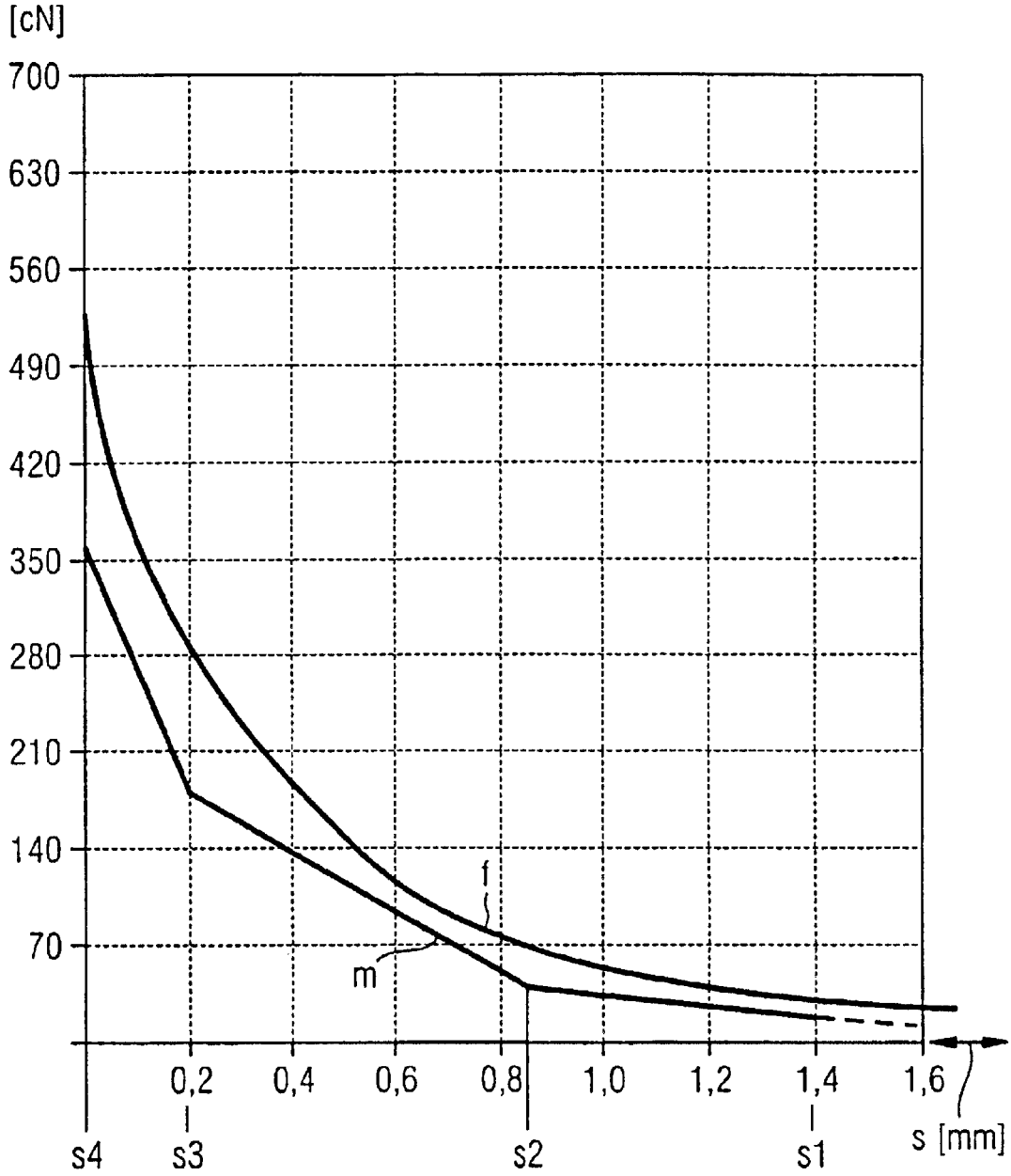

FIG. 1 shows a relay formed according to the invention, in an exploded illustration;

FIG. 2 shows the relay from FIG. 1 in the assembled condition, with the slide partially cut away and without a cover, in a perspective illustration;

FIG. 3 shows the relay from FIG. 2 in a rotated perspective illustration;

FIG. 4 shows the relay from FIGS. 1 to 3 in side view, partially in longitudinal section;

FIGS. 5 and 6 show the slide of the relay from FIGS. 1 to 4 in two perspective views; and FIG. 7 shows a graph to illustrate the fundamental form of the force/distance characteristic curves of the magnet system and the springs of the relay.

DETAILED DESCRIPTION OF THE PREFERRED EMBODIMENT

The relay illustrated in FIGS. 1 to 6 has a base 1 made of insulating material, which is substantially flat in form and defines a base side 10, and with a cover 2 forms a closed housing. The base 1 has a flat, trough-shaped recess 11 for receiving a magnet system, while the remaining part, having raised side walls 12, a longitudinal intermediate wall 13 and transverse walls 14, forms two rows of contact beam chambers 15. These contact beam chambers 15 narrow downwardly in the manner of slots to form plug-type channels 16 (see FIG. 4), in order to receive fixed contact beams 21 or spring contact beams 22 which may be plugged in, in each case from above, perpendicularly to the base plane 10. The fixed contact beams 21 each form at their free ends passive (or fixed) spring contacts 23 with fixed contact portions 24 secured thereto, while active (or movable) spring contacts 25 with movable contact portions 26 secured to their free ends are in each case secured to the spring contact beams 22.

The magnet system serving to actuate the relay has a U-shaped core yoke 31 with a core limb 32 and a yoke limb 33. A coil body 34 bears an excitation coil 35 and receives the core limb 32 in an axial through opening. Since this core limb has a smaller width than the yoke limb 33, because of the limited width of the core, an additional flux guide part 36 is inserted into the interior of the coil, together with the core limb 32. In this way, the cross-section of iron within the coil is enlarged, as are the pole surfaces 32*a* and 36*a*, with which an armature 37 co-operates. This armature is mounted at the free end of the yoke limb 33 with the aid of an armature spring 38, and forms an operational air gap in a conventional manner with the pole surfaces 32*a*, 36*a*. Two restoring limbs 39 of the armature spring 38 provide the rest position for the contacts, in the non-excited condition of the magnet system.

Movement of the armature 37 is transmitted by way of an armature extension portion 37*a* to a slide 40 and by way of the latter to the active spring contacts 25. Since the spring contacts are arranged on the side of the magnet system opposite the armature, the slide has a connection portion 41 which extends above the coil and is adjoined by an actuating portion 42 which is set back in a stepped manner, downwardly in the direction of the base plane. This actuating portion forms, together with a central longitudinal wall 43 and side walls 44 and transverse walls 45 and 46 respectively, frames for each individual spring contact, which screen these spring contacts, with the exception of the respectively first passive spring contacts 24R and the respectively last passive spring contacts 23R and 23A2, which are in the end regions of the actuating portion 42 of the slide 40 and thus do not need any screening on one side with respect to an adjacent spring contact. By way of explanation, it should be noted here that the active and passive spring contacts 25 and 23 in FIG. 4 are provided with additional designations to indicate the type of contact, in other words 23A1, 23A2 for passive operational spring contacts (closing spring contacts), 23R for passive rest spring contacts (opening spring contacts), 25A1 and 25A2 for active operational spring contacts (closing spring contacts) and 25R for active rest spring contacts (opening spring contacts). Within the frames of the slide 40, formed by partition walls 43, 44, 45 and 46, windows 47 are recessed for the active spring contacts and windows 48 are recessed for the passive spring contacts, respectively. The respective passive spring contacts 23 and active spring contacts 25 project through these windows so that the ends bearing contact portions 24 and 26 respectively are each located above the actuating portion 42 of the slide and substantially within the frames formed by partition walls 43, 44, 45 and 46.

Those transverse walls or blocking walls 46, which each separate co-operating active and passive spring contacts, each have an approximately semi-circular recess 49 to match the round contour of the contact portions. A movable contact portion 26 of the active spring contacts 25 is guided respectively in this recess 49. This means that the active spring contact can itself bear snugly against the blocking wall 46 or a blocking rib 50 projecting from the blocking wall. Moreover, the slide forms actuating lugs 52 which project inwards in each case from the side walls 44 and actuate the active operational spring contacts or the active rest spring contacts respectively at different heights. The active spring contacts are in this case each arranged within the window 47 and are guided between the respective blocking rib 50 and the associated actuating lug 51 or 52 with a small amount of play. This means that if a contact welds, all the other active spring contacts are also blocked with respect to any further switching actuation.

When the relay is put together, first of all the assembled magnet system is inserted in the recess 11 in the base 1, with the armature spring 38 being secured between the yoke limb 33 and the base. The slide 40 is placed with its connection portion 41 on the magnet system, with the restoring limbs 39 of the armature spring 38 suspended in the apertures 41*a* in the slide. The armature itself is at the same time mounted on the yoke limb 33 and suspended by means of its extension portion 37*a* in the aperture 41*b* in the slide 40.

Once the slide 40, which is seated with its longitudinal partition wall 43 on the longitudinal wall 13 and with the longitudinal walls 44 on the side walls 12 of the base 1, has been mounted, the spring contacts are mounted. For this, all the spring contacts are inserted through the appropriate windows 47 and 48 in the slide, into the chambers 15 of the base, and secured in the plug-type slots 16. All the fixed contact beams 21 with the passive spring contacts 23 are of the same construction and straight, so that they can be inserted into the base perpendicularly with respect to the base plane. Moreover, all the active spring contacts 25 with their spring contact beams 22 are of the same construction and straight, so that they can be inserted through the associated windows 47 in the slide, perpendicularly with respect to the base plane, regardless of their function as operational spring contacts 25A1, 25A2 or rest spring contacts 25R. The slide 40 is for this purpose held in a central position in opposition to the pre-tension of the armature spring 38.

With this construction, all the spring contacts must be inserted into the base from above through the already mounted slide 40, because the end portions of the spring contacts, at least those of the active spring contacts 25 having the contact portions 26, have a larger cross-section than the windows 47, so that the slide cannot be pushed from above over the spring contacts afterwards. As a result of these relative sizes, on the one hand the slide is made stable because of the closed frames around the spring contacts, and on the other hand a broken-off contact portion cannot fall through a window 47 down into a spring chamber and there perhaps cause a short circuit.

In the non-excited condition of the magnet system, the slide is drawn into the rest position by the restoring force of the armature spring 38, that is to say to the right in FIG. 4. During this, the rest spring contacts 25R, which are straight in the untensioned condition, are drawn to the right, into the position shown in FIG. 4, so that they make contact with the passive spring contact 23R.

When the magnet system is excited, the slide is moved to the left in FIG. 4, and the active rest spring contact 25R is raised away from the passive rest spring contact 23R and moved into its opened operational position by the blocking rib 50R. At the same time, the slide acts by means of the actuating lugs 51 laterally on the active operational spring contacts 25A1 and 25A2, and moves the latter in the direction of the passive operational spring contacts 23A1 and 23A2 until the corresponding operational contacts have been made. When the excitation is switched off, the armature spring 38 restores the rest condition, with the slide 40 acting laterally by way of the actuating lugs 52 on the contact portions 26R and making the rest contacts. If one of the contacts welds, then the narrow guideway of the active spring contacts 25 ensures that further movement of the slide 40 and thus further actuation of the other contacts is blocked. If, for example, a rest contact welds, hen the slide is blocked to prevent further movement, by way of the blocking rib 50R, which acts directly next to the contact portion. The operational contacts cannot therefore close. If, by contrast, an operational contact welds, then similarly by way of the blocking rib 50A acting on the associated spring contact next to the welded contact, the position of the slide is prevented from being restored and the rest contacts are prevented from being actuated.

Since, moreover, all the active spring contacts are constructed to be straight, they have the effect of opening by themselves. If for example an actuating lug 51 or 52 on the slide breaks, then the active spring contact (opening contact) concerned opens, or is not closed (in the case of a closing contact). If by contrast the armature spring 38 breaks, then all the rest contacts (opening contacts) open and all the closing contacts are not closed again.

As can be seen from the description and in particular from FIGS. 4, 5 and 6, the actuating lugs 52 for the active rest spring contacts 25R are substantially higher up with respect to the base plane than the actuating lugs 51 for the active operational spring contacts 25A1 and 25A2. As a result, the force/distance leverage is different for the operational contacts and the rest contacts. Since the magnet system is in each case strongest in the closed condition, that is to say when the armature is attracted or almost at the attracted position, while when the armature has fallen away the force increases only slowly as a result of the large air gap, normally the magnet system must be sized so as to ensure that the magnet system applies sufficient force even at the beginning of the armature movement of attraction, in order to actuate the rest contacts in the opening direction and hence to overcome the restoring force of the armature spring. As a result of the offset arrangement of the actuating points or the actuating lugs 51 and 52 with respect to the base plane, the effect is that the active opening spring contacts are actuated with less force and over a longer distance, while the active closing spring contacts are made to close over a short distance as a result of the shorter leverage. At this moment, the magnet system already has more force since the armature has already largely approached the pole surface. As a result of this measure, in particular with the construction of a safety relay in which no switch-over contacts are used, but rather separately actuable opening and closing contacts, the efficiency of the magnet system can be increased, with the result that it can be of smaller size than is otherwise conventionally the case.

In the graph of FIG. 7, the way the force/distance characteristic curves are adapted is shown. Here, f designates the characteristic curve of the totalled spring forces and m designates the characteristic curve of the magnet system. The forces F which act in each case in opposition to one another are applied over the distance s, which represents the movement of the armature and the movement of the slide 40 between the rest position (on the right in FIG. 4, with the armature opened) and the operational position (on the left in FIG. 4, with the armature closed). In the rest condition, the slide is for example at the point s1 or to the right of it, depending on the contact erosion. When the armature is attracted, the slide moves to the left, with the force m of the magnet system first rising only slowly. In this range, as far as s2, however, the opening force to be overcome (at the active rest spring contact or the armature spring adapted thereto) is also still relatively small because of the large leverage. From s2 to s3, the active operational spring contacts produce a more steeply rising spring force which is overcome by a magnetic force m, which also rises more steeply in this range. From s3 to the point of abutment, both the spring force f and the magnetic force rise steeply. This is the range of the overtravel to the point s4.

What is claimed is:

1. A relay comprising: a base that defines a base plane; a magnet system arranged on the base including a coil, a core and an armature; at least one pair of closing spring contacts and at least one pair of opening sprig contacts, each pair of spring contacts including a passive and an active spring contact, and each spring contact being secured in the base, standing essentially perpendicular to the base plane, and having at an end remote from the base a contact portion; and an actuating slide movable parallel to the base plane to act on each active spring contact, the slide being configured to act on the active spring contact of the pair of opening spring contacts at a different distance from the base than the distance from the base at which the slide acts on the corresponding closing spring contacts.

2. The relay according to claim 1, wherein the slide acts on the active opening spring contact at a greater distance from the base than the distance from the base at which it acts on the active closing spring contacts.

3. The relay according to claim 2, wherein all of the active spring contacts are of the same configuration.

4. The relay according to claim 1, wherein in the untensioned condition all the active spring contacts adopt an open position with respect to their associated passive spring contacts, and in that the active opening spring contacts are switched by the force of a restoring spring and the active closing spring contacts are switched by the force of the magnet system to their respective closing position.

5. The relay according to claim 1, wherein the magnet system has a U-shape core with a core limb lying inside the coil and a yoke limb lying outside the coil with the cross-section of iron within the core limb being increased by an additional flux member.

6. A relay comprising at least one active closing spring contact having a contact portion thereon, at least one active opening spring contact having a contact portion thereon, and a slide, the spring contacts being fixed at a base plane remote from the contact portions, and the slide configured to move parallel to the base plane and to engage the active opting spring contact and the active closing spring contact at different distances from the base plane.

7. The relay according to claim 6 further comprising a passive opening spring contact and a closing spring contact corresponding to each active opening spring contact and closing spring contact respectively, and wherein the slide has blocking walls extending between and separating each pair of corresponding spring contacts.

8. The relay according to c claim 7 wherein at least one of the blocking walls has a recess to accommodate the contact portion of the corresponding spring contact.

9. A relay comprising:

at least one active closing spring contact having a contact portion thereon, the closing spring contact being fixed at a base plane remote from the contact portion;

at least one active opening spring contact having a contact portion thereon, the closing spring contact being fixed at a base plane remote from the contact portions; and an integral slide moveable parallel to the base plane and having a first rib positioned at a first acting point to engage the opening contact portion at a first distance from the base plane and a second rib positioned at a second acting point to engage the closing spring contact portion, the first rib and the second rib being located at different distances from the base plane relative to one another.

10. The relay according to claim 9 wherein the integral slide is stepped relative to the base plane such that the first rib is farther from the base plane than the second rib.

* * * * *

UNITED STATES PATENT AND TRADEMARK OFFICE

CERTIFICATE OF CORRECTION

PATENT NO. : 6,906,604 B1
DATED : June 14, 2005
INVENTOR(S) : Mader et al.

It is certified that error appears in the above-identified patent and that said Letters Patent is hereby corrected as shown below:

Column 6,
Line 32, "engage the active opting" should read -- engage the active opening --.
Line 47, "from the contact portion;" should read -- from the contact portions; --.

Signed and Sealed this

Twenty-first Day of February, 2006

JON W. DUDAS
*Director of the United States Patent and Trademark Office*